US012378902B2

(12) United States Patent
Cisar et al.

(10) Patent No.: US 12,378,902 B2
(45) Date of Patent: Aug. 5, 2025

(54) ROLLER ROCKER ARM ASSEMBLY

(71) Applicant: Eaton Intelligent Power Limited, Dublin (IE)

(72) Inventors: Ondrej Cisar, Dvur Kralove nad Labem (CZ); Zdenek Hubner, Kamen (CZ)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/246,888

(22) PCT Filed: Oct. 1, 2021

(86) PCT No.: PCT/EP2021/025379
§ 371 (c)(1),
(2) Date: Mar. 28, 2023

(87) PCT Pub. No.: WO2022/069080
PCT Pub. Date: Apr. 7, 2022

(65) Prior Publication Data

US 2023/0407770 A1 Dec. 21, 2023

Related U.S. Application Data

(60) Provisional application No. 63/086,260, filed on Oct. 1, 2020.

(51) Int. Cl.
*F01L 1/18* (2006.01)
*F01L 1/053* (2006.01)
(Continued)

(52) U.S. Cl.
CPC ..... *F01L 1/181* (2013.01); *F01L 1/053* (2013.01); *F01L 13/0015* (2013.01); *F01L 1/26* (2013.01);
(Continued)

(58) Field of Classification Search
CPC ..... F01L 1/181; F01L 1/053; F01L 13/0015; F01L 1/26; F01L 2001/467; F01L 2305/00; F01L 2305/02; F01L 1/18; F01L 1/267
See application file for complete search history.

(56) References Cited

U.S. PATENT DOCUMENTS 4,726,332 A 2/1988 Nishimura et al.
7,146,945 B2 12/2006 Persson
(Continued)

FOREIGN PATENT DOCUMENTS

AT 511050 A1 * 8/2012 ..... F01L 13/0036
CN 1598251 A * 3/2005 ..... F01L 1/181
(Continued)

OTHER PUBLICATIONS

CN-1598251-A, English Language machine Translation (Year: 2005).*
(Continued)

*Primary Examiner* — Wesley G Harris
(74) *Attorney, Agent, or Firm* — Meunier Carlin & Curfman LLC

(57) ABSTRACT

A center pivot roller rocker arm assembly can comprise a main roller rocker arm, a second roller rocker arm, and a latching assembly. The main roller rocker arm can comprise a rocker shaft bore, a valve end, a cam end, and a main cam surface on the cam end. The second roller rocker arm can comprise a second rocker shaft bore, a second cam end, and a second cam surface on the second cam end. The latching assembly can be coupled to the rocker shaft bore and configured to latch and unlatch the main roller rocker arm to the second roller rocker arm. A lost motion assembly can be configured with the main and second roller rocker arms. A main cam surface can have a different extent for receiving cam actuation than a second cam surface.

12 Claims, 5 Drawing Sheets

(51) Int. Cl.

| | |
|---|---|
| ***F01L 13/00*** | (2006.01) |
| *F01L 1/26* | (2006.01) |
| *F01L 1/46* | (2006.01) |

(52) U.S. Cl.
CPC ..... *F01L 2001/467* (2013.01); *F01L 2305/00* (2020.05)

(56) References Cited

U.S. PATENT DOCUMENTS

| | | | | |
|---|---|---|---|---|
| 7,150,272 | B2 | 12/2006 | Persson | |
| 7,392,772 | B2 | 7/2008 | Janak et al. | |
| 9,926,816 | B2 | 3/2018 | Ahmed et al. | |
| 10,781,729 | B1 * | 9/2020 | Foster | F01L 13/0021 |
| 10,907,514 | B2 | 2/2021 | Contarin et al. | |
| 2005/0188930 | A1 * | 9/2005 | Best | F01L 13/0005 123/90.2 |
| 2011/0203549 | A1 * | 8/2011 | Schnell | F02D 13/04 123/322 |
| 2017/0009610 | A1 * | 1/2017 | Ahmed | F01L 1/2416 |
| 2019/0284971 | A1 * | 9/2019 | Vance | F01L 1/46 |
| 2020/0408113 | A1 * | 12/2020 | Radulescu | F01L 1/047 |
| 2021/0262366 | A1 * | 8/2021 | Van Wingerden | F01L 1/2416 |

FOREIGN PATENT DOCUMENTS

| | | | | | |
|---|---|---|---|---|---|
| CN | 114450469 | A | * | 5/2022 | F01L 1/181 |
| CN | 115667676 | A | * | 1/2023 | F01L 1/181 |
| DE | 4406008 | A1 | | 9/1994 | |
| DE | 4412851 | A1 | * | 5/1995 | F01L 13/0036 |
| DE | 102015015087 | A1 | * | 5/2017 | F01L 1/047 |
| DE | 102016219695 | A1 | | 4/2018 | |
| EP | 1712748 | B1 | | 4/2010 | |
| EP | 3170997 | A1 | * | 5/2017 | F01L 1/047 |
| WO | WO-2005019610 | A1 | * | 3/2005 | F01L 1/181 |
| WO | WO-2021047796 | A1 | * | 3/2021 | F01L 1/181 |
| WO | 2021/165993 | A1 | | 8/2021 | |
| WO | WO-2021239273 | A1 | * | 12/2021 | F01L 1/181 |
| WO | WO-2022111856 | A1 | * | 6/2022 | F01L 1/181 |
| WO | 2022/242850 | A1 | | 11/2022 | |

OTHER PUBLICATIONS

DE-102015015087-A1, English Language Machine Translation (Year: 2015).*
AT-511050-A1, English Language Machine Translation (Year: 2011).*
International Search Report issued in corresponding application No. PCT/EP2021/025379 dated Jan. 21, 2022, 4 pages.
Written Opinion issued in corresponding application No. PCT/EP2021/025379 dated Jan. 21, 2022, 9 pages.

* cited by examiner

ROLLER ROCKER ARM ASSEMBLY

CROSS-REFERENCE TO RELATED APPLICATIONS

This is a National Stage application of PCT international application PCT/EP2021/025379 filed on Oct. 1, 2021, which claims priority to U.S. Provisional Patent Application No. 63/086,260, filed Oct. 1, 2020, which are incorporated herein by reference in their entireties.

FIELD

This application provides a roller rocker arm assembly. A main roller rocker arm can be latched and unlatched to a second roller rocker arm to vary the lift profile to a valve end of the roller rocker arm assembly.

BACKGROUND

The automotive sector is trying to decrease fleet emission to fulfill strict regulations. Systems implementing variable valve actuation (VVA), variable valve timing (VVT), variable valve lift (VVL) etc. are able to help with these issues. However, these systems can be complex, custom to a particular valvetrain, and can require numerous cams to actuate. Custom design and scrap of high precision parts presents difficulty in implementation.

SUMMARY

The methods and devices disclosed herein overcome the above disadvantages and improves the art by way of a roller rocker arm assembly, an overhead cam engine system comprising the roller rocker arm assembly, a latching assembly for the roller rocker arm assembly, and off-set extent main and secondary cam surfaces for the roller rocker arm assembly.

A roller rocker arm assembly can comprise a main roller rocker arm (RRA), a second roller rocker arm (RRA), a latching assembly, and a lost motion assembly. The roller rocker arm assembly can be of the center pivot type, also called a Type III.

A center pivot roller rocker arm assembly can comprise a main roller rocker arm, a second roller rocker arm, and a latching assembly. The main roller rocker arm can comprise a rocker shaft bore, a valve end, a cam end, and a main cam surface on the cam end. The second roller rocker arm can comprise a second rocker shaft bore, a second cam end, and a second cam surface on the second cam end. The latching assembly can be coupled to the rocker shaft bore and configured to latch and unlatch the main roller rocker arm to the second roller rocker arm.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Figure 1:
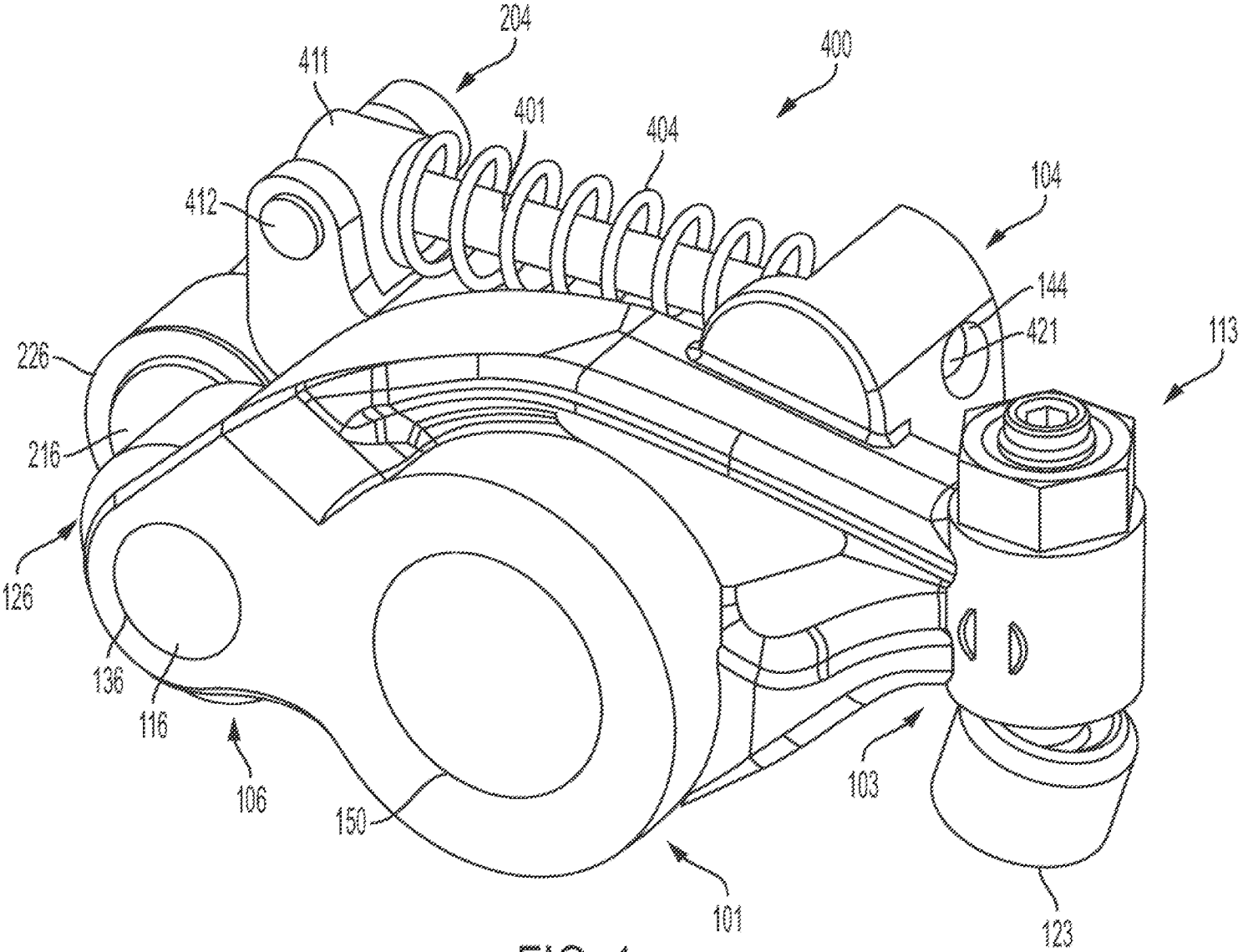
FIG. 1 is a view of a center pivot roller rocker arm assembly.
Figure 2:
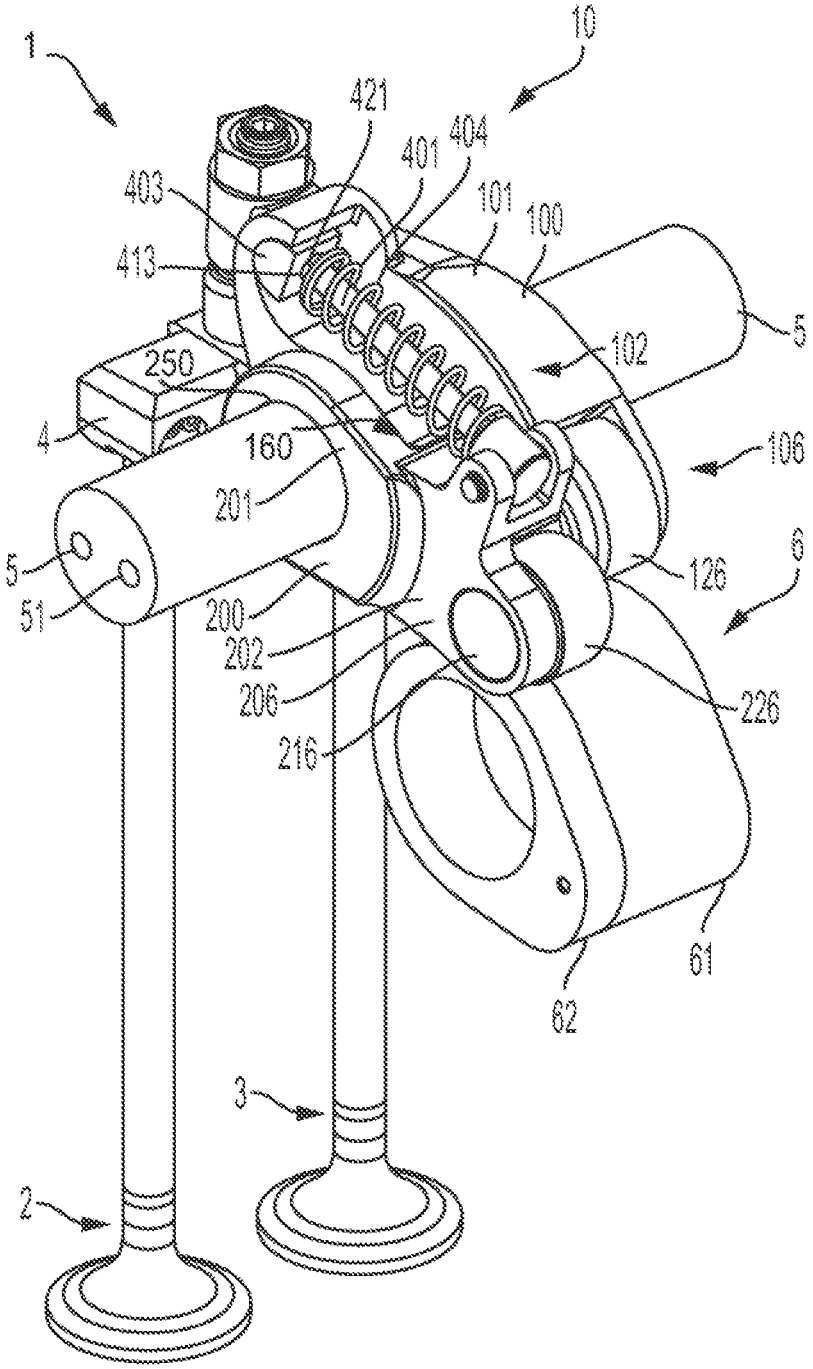
FIG. 2 is a view of a portion of a valvetrain for an overhead cam engine system comprising the center pivot roller rocker arm assembly.

Reference will now be made in detail to the examples which are illustrated in the accompanying drawings. Wherever possible, the same reference numbers will be used throughout the drawings to refer to the same or like parts.

This roller rocker arm 10 can be used in various cases where variable valve timing is required. Advantages include additional function, flexibility in shifting the angle of valve lift, flexible use of latching, absence of an overhead constant-contact device (spring rail), and ability to use a single actuation cam lobe profile.

Other latch assemblies are compatible herewith. While a radial latch assembly 300 is shown herein in latch region 202, a transverse assembly can be substituted. Locking can be between abutting body portions 101, 201 in a direction parallel to the rocker shaft 5.

Figure 5:
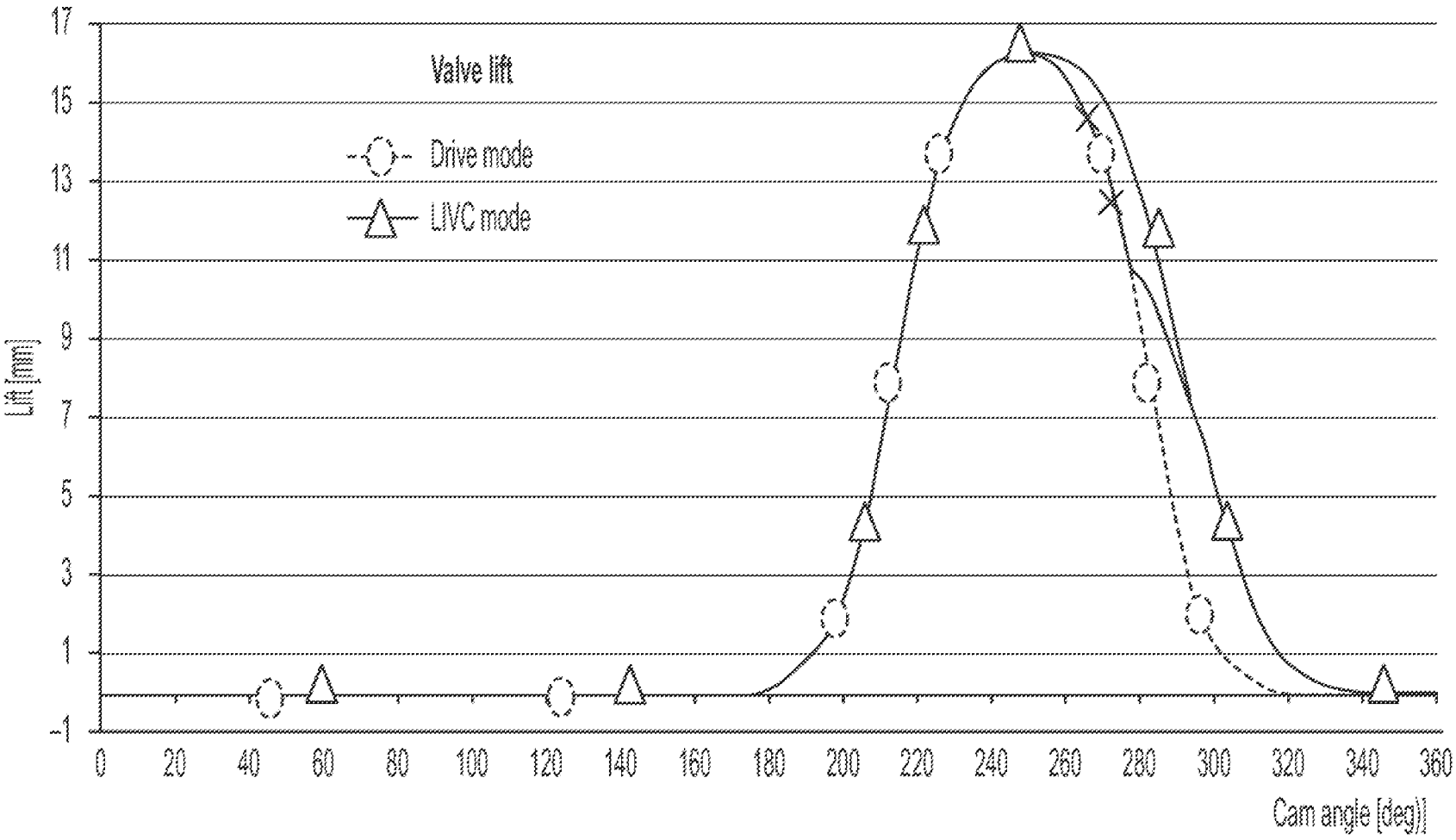
FIG. 5 is an example of switchable valve lift modes.

With the automotive sector trying to decrease fleet emission to fulfill strict regulations, systems designed with auxiliary lift profiles, also called variable valve actuation (VVA), variable valve timing (VVT), variable valve lift (VVL) etc., can be designed. While the working example of FIG. 5 supports switching between a late intake valve closing (LIVC) mode and a drive mode, the idea could be used for various VVA systems where the lift profiles are varied from engine cycle to engine cycle. Early or late actuation can be applied to intake or exhaust valves to support known techniques, such as early exhaust valve opening (LEVO), early intake valve closing (EIVC), late exhaust valve opening (LEVO), late exhaust valve closing (LEVC), negative valve overlap (NVO), internal exhaust gas recirculation (iEGR) among many other techniques. So, the teachings herein can be applied to intake valves, exhaust valves, or combinations of intake and exhaust valves. Additional flexibility in auxiliary or drive mode actuation can be had via capsule 113 in valve end 103. A lash adjuster, lubricated spigot, deactivation capsule, brake capsule, or other structure can be installed in the valve end. An e-foot 123 is also shown.

A roller rocker arm assembly 10 for use in an overhead cam (OHC) Type III engine system are shown in FIGS. 1-4B. When assembled together with valves 2, 3, a valvetrain 1 can be referenced. The roller rocker arm assembly 10 can be called a center pivot roller rocker arm assembly because of its compatibility with the overhead cam Type III engine system. A main roller rocker arm (RRA) 100, a second roller rocker arm (RRA) 200, a latching assembly 300, and a lost motion assembly 400 are shown.

Valvetrain 1 can comprise a rotatable cam 6 that can comprise a single outer lobe profile or a set of outer lobe profiles. It is possible to have a single outer lobe profile for ease of manufacture, but a main lobe with a main lift profile 61 and main base circle 63 can be paired with a second lobe of a second lift profile 62 and a second base circle 64. A rocker shaft 5 with oil port 51 and vent 52 can be configured parallel to a cam rail for cam 6. The roller rocker arm assembly 10 can rotate on the rocker shaft 5 in response to the rotating cam 6. Valves 2, 3 can lift and lower. A valve bridge 4 can be included so that more than one valve 2, 3 can be actuated at a time. But, single valve actuation is not precluded.

The design of the cam lobe 6 controls the extent to which the valves 2, 3 move. But, additional degrees of freedom for the design can be had by designing the main cam surface 126 and the second cam surface 226. As shown in broken lines in FIG. 5, a drive mode can be configured to lift and lower a valve, with a shape of cam 6 directing the lift profile. A late intake valve closing (LIVC) mode can follow much of the drive mode lift profile and then switch to a new profile that extends past the drive mode lift profile so that the valves 2, 3 close later in LIVC mode than in drive mode. The switch between drive mode and LIVC mode can be accomplished by actuating the latching assembly 300.

Figure 3:
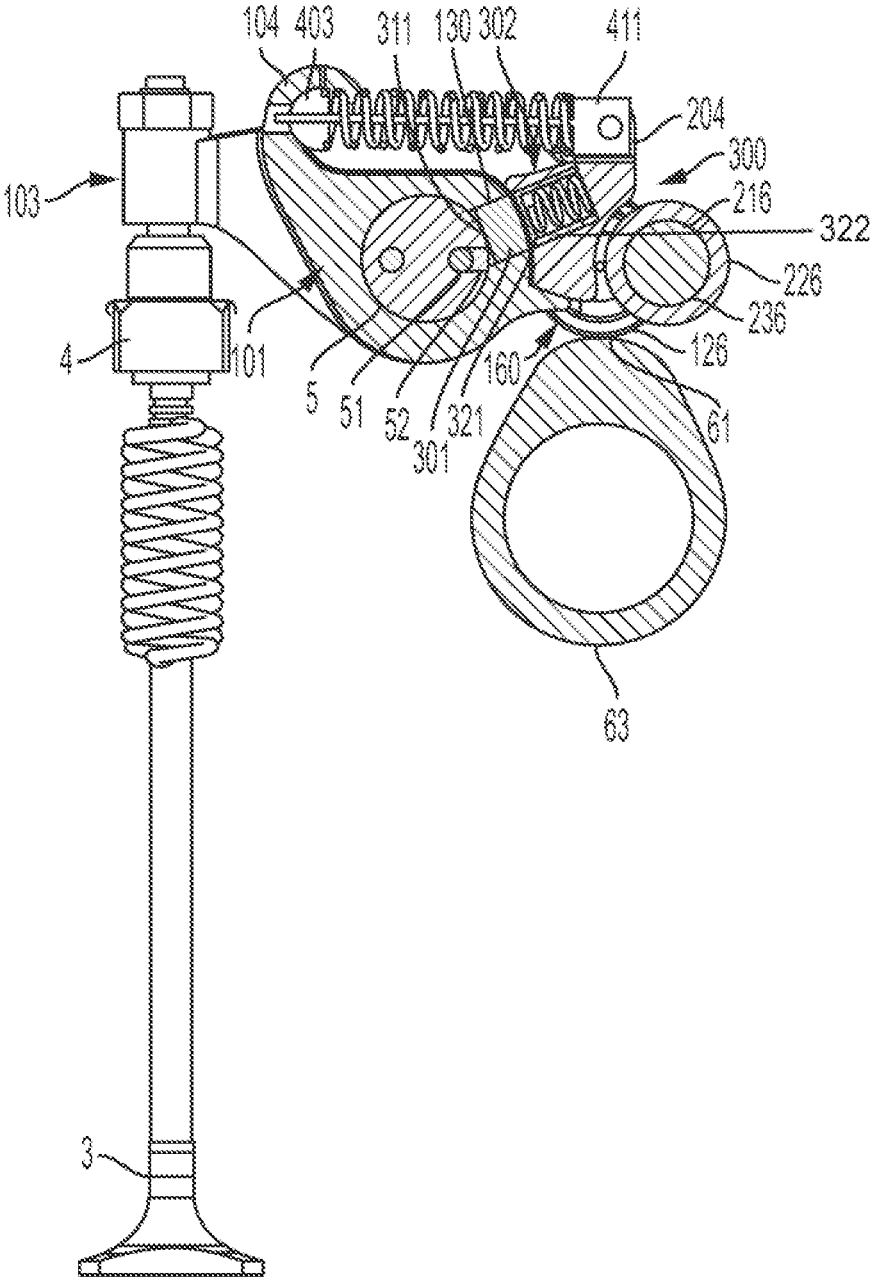
FIG. 3 is a section view of an unlatched roller rocker arm assembly.

The main cam surface 126 can be configured to receive the drive mode lift profile from the cam 6 while the latching assembly 300 in unlatched (FIG. 3). But when the latching assembly 300 is latched, the roller rocker arm assembly can transition from the main cam surface 126 following the cam 6 to the second cam surface 226 following the cam 6. Unlike prior art rocker arms that abruptly step to the new lift profile (crossed out portion of FIG. 5), the disclosed roller rocker arm assembly 10 can maintain a smooth valve lift profile that does not "step out" or cause a contact stress or banging of parts to accomplish the change in valve lift profile. The auxiliary valve lift profile (LIVC mode in this example) is smoothly transitioned to without harsh contact stresses.

This is accomplished by having a point where both the main cam surface 126 and the second cam surface 226 are in contact with the cam 6 and at the same time. At this time, the valve velocity could be approximately equal to zero.

Figure 4B:
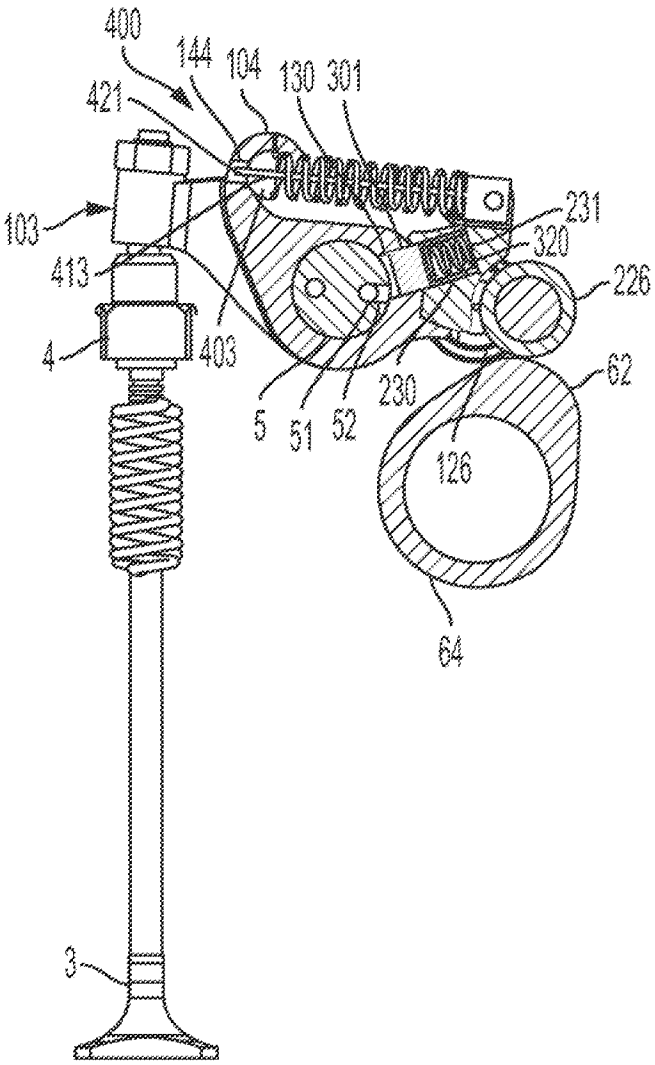
FIGS. 4A & 4B are views of a latched roller rocker arm assembly.
Figure 4A:
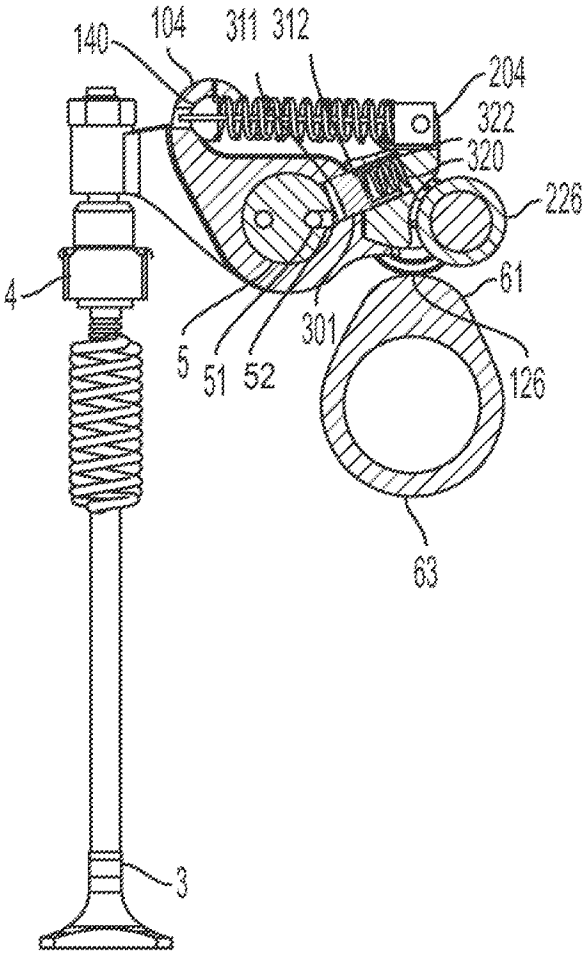

So, with the latching assembly 300 latched, the cam 6 can rotate from main base circle 63 to the main lift profile 61, as shown in FIG. 4A. FIG. 4A corresponds to approximately 230-240 degrees of cam angle in FIG. 5. Upon further rotation of cam 6, the second cam surface 226 comes into contact with cam 6, shown in FIG. 4B. The second lift profile 62 can be an extension of main lift profile 61, as by being an integral part. Or, additional profiles can be supplied to second lift profile 62 to hold the valve open or to modulate the closing of the valves 2, 3. As shown in FIG. 4B, both main cam surface 126 and second cam surface 226 touch the cam 6. This corresponds to approximately 250 degrees of cam angle in FIG. 5. The second cam surface 226 follows the cam 6 through the rest of cam rotation and the auxiliary (LIVC mode) valve lift is applied to valves 2, 3.

When the latching assembly 300 is unlatched, the second cam surface 226 cannot transfer any of its lift profile to roller rocker arm assembly 10. Even if second cam surface 226 contacted cam 6, force would not transfer to the valve end 103. However, during the drive mode, the main cam surface 126 of the main roller rocker arm 100 remains in direct contact with the cam 6. But, at the top of valve lift, the second cam surface 226 of the second roller rocker arm 200 starts rolling on the cam 6. Lost motion assembly 400 pushes on the second roller rocker arm 200 in such a way that lost motion spring 404 causes the second cam surface 226 to contact the cam 6. The second roller rocker arm 200 is able to sway in lost motion.

After a command from an Electronic Control Unit (ECU) to an oil control valve (OCV), hydraulic fluid such as oil can flow in an oil gallery formed by oil port 51 to vent 52. The pressure can actuate the latching assembly 300. Latching assembly 300 can comprise main latch socket 130 in main roller rocker arm 100. Main latch socket 130 can extend out from the rocker shaft bore 150 in body portion 101. A main latch 301 can be configured to slide in the main latch socket 130 in response to pressurized hydraulic fluid so that the main latch 301 slides to engage the second roller rocker arm 200. The main latch 301 can slide into a second latch socket 230 in the second roller rocker arm 200 to latch the main roller rocker arm 100 to the second roller rocker arm 200. This can press a secondary latch 302 to slide in the second latch socket 230 towards a bias wall 231. A pressure plate 321 with plate guides 322 can restrict the travel of the main latch 301 into the second latch socket 230, as by the plate guides 322 abutting a bias wall 231 or other stop. This way, the main latch 301 does not overtravel or exit the main latch socket 130.

When the pressurized hydraulic fluid is reduced against the oil wall 311 of the main latch 301, the catch end 312 of the main latch 301 is pushed back into the main latch socket 130 and out of the second latch socket 230 by a latch spring 320 pushing against the bias wall 231 and the pressure plate 321. While a stop can be included to limit the travel of the main latch 301, the rocker shaft 5 can instead serve as a travel limit. For packaging, the main latch socket 130 can be offset in the body portion 201 so that the latch socket 130 is not co-planar with the main cam surface 123. The cam end 206 can comprise a roller pin 216 in a pin bore 236, with a roller rotating on the roller pin 216 as the main cam surface 226. These things can be packaged parallel to the main latch socket 130 in the main body portion 101. The second latch socket 230 can then be configured between the second cam surface 226 and a lost motion mount 204. These can be packaged parallel to the main cam surface aspects. This geometry allows for tighter packaging. The latch can be accommodated without extending the main cam surface 126 further away from the pivot point at the rocker shaft 5.

Said another way, the main roller rocker arm 100 can comprise a recess 160 in the cam end 106. The second cam end 206 can seat in the recess 160. The recess 160 can be formed in the main roller rocker arm 100 by a step so that the cam end 106 and the valve end 103 are co-planar, but a lost motion mount 104 is not co-planar with the cam end 106 or the valve end 103. The second roller rocker arm 200 can likewise be stepped to sway in the recess 160 so that a body portion 201 abuts the main roller rocker arm 100 while a second lost motion mount 204 is co-planar with the lost motion mount 104 and the second cam surface 226.

A lost motion assembly 400 can be coupled between the main roller rocker arm 100 and the second roller rocker arm 200. The lost motion assembly 400 can be positioned over the rocker shaft bore 150. By its stepped geometry, the lost motion assembly 400 can also be positioned over the second cam end 206.

The lost motion assembly 400 can comprise a lost motion socket 104 on the main roller rocker arm 100 and a lost motion mount 204 at or above the second cam end 206. A spring guide 401 can comprise a pivot end 411 mounted to the lost motion mount 204. Second lost motion mount 204 can comprise a clevis with pin holes 214 to anchor a tang of pivot end 411. The main lost motion mount 104 can comprise a socket 140, and the second lost motion mount 104 can comprise the clevis. The spring guide 401 can be mounted to span the socket 140 and the clevis. A guide end 421 of the spring guide 401 can be positioned in the lost motion socket 104. A rotatable member 403 can be received to rotate in a socket 140 of the lost motion mount 104. There can be a ball-and-socket type arrangement, with a half-cylinder being shown for rotatable member 403. The guide end 421 can be positioned with the rotatable member 403. The rotatable member 403 can comprise a pass-through 413. The guide end 421 can be slidable in the pass-through 413. The lost motion socket 140 can comprise a socket pass-through 144. The guide end can be slidable in the socket pass-through 144. Then, when the latching assembly 300 is unlatched, and small amount of play can be given to the second roller rocker arm 200 (called "sway" above). Motions in the second roller rocker arm 200 can be guided by the seating of the rotatable member 403 in the socket 140, and the guide end 421 of the spring guide 401 being guided in one or both of the pass-through 413 and the socket pass-through 144.

Lost motion spring 404 can press against the pivot end 411 and the rotatable member 403 to push the second roller rocker arm 200 relative to the main roller rocker arm 100, with forces directing the second cam surface 226 to roll on the cam 6 even at times when the latching assembly 300 is unlatched.

The latching assembly 300 can bond together the main roller rocker arm 100 and the second roller rocker arm 200. Main roller of main cam surface 126 can be in contact with the cam 6 until the second roller of the second cam surface 226 takes the valve lifting function. This can be at a point where valve velocity could be approximately equal to zero. By designing a rocker ratio difference between the main roller and the second roller, the valve closing point is different.

A main cam surface can have a different extent for receiving cam actuation than a second cam surface. This design feature adds an additional degree of design freedom. The main roller and second roller can be select-fit to the cam 6. Or, the roller pins 116, 226 can make for easy exchange of a main or second roller such that different auxiliary functions and drive mode valve lift profiles can be installed on a stock set of main and second roller rocker arm 100, 200. For example, a lift height can be changed by the diameter of the main or second roller while keeping the same cam 6, among other options. By different diameters or different installation angles, the main and second cam surfaces offer different lift profiles. If such rolling or select fitting is not desired, a tappet or other sliding surface can be substituted for main and second rollers.

The roller rocker arm assembly 10 is designed so that, at the maximal valve lift (≈zero valve velocity) there is a point where the main and second rollers of the main and second cam surfaces 126, 226 are in contact simultaneously. But, when the latching assembly 300 is unlatched, the main cam surface 126 is configured to convey a main valve lift profile to the valve end 103. When the latching assembly 300 is latched, the second cam surface 226 is configured to convey a second valve lift profile to the valve end 103.

The roller rocker arm assembly 10 can be configured so that the main cam surface 126 is configured with a roller of a main extent, and the second cam surface 226 is configured with a second roller of a second extent. The main extent and the second extent can be configured so that a rotating cam 6 does not act on both the main cam surface 126 and the second cam surface 226 when the latching assembly is unlatched. Then, only the main cam surface 126 transfers the action of the cam 6 to the valve end 103.

The main cam surface 126 can be configured with a roller of a main extent, and the second cam surface 226 can be configured with a second roller of a second extent. The main extent and the second extent can be configured so that a rotating cam 6 acts on both the main cam surface 126 and the second cam surface 226 when the latching assembly is latched. This dual action can be limited to a small number of degrees of cam rotation.

Other implementations will be apparent to those skilled in the art from consideration of the specification and practice of the examples disclosed herein.

What is claimed is:

1. A center pivot roller rocker arm assembly comprising:
a main roller rocker arm comprising:
a rocker shaft bore;
a valve end;
a cam end; and
a main cam surface on the cam end;
a second roller rocker arm, comprising:
a second rocker shaft bore;
a second cam end; and
a second cam surface on the second cam end;
a latching assembly coupled to the rocker shaft bore and configured to latch and unlatch the main roller rocker arm to the second roller rocker arm; and
a lost motion assembly coupled between the main roller rocker arm and the second roller rocker arm, the lost motion assembly comprising:
a lost motion socket on the main roller rocker arm;
a lost motion mount at the second cam end; and
a spring guide comprising:
a pivot end mounted to the lost motion mount; and
a guide end positioned in the lost motion socket,
wherein, when the latching assembly is latched, at a predetermined cam angle of an adjacent cam both the main cam surface and the second cam surface are configured to contact the adjacent cam and after the predetermined cam angle and until a valve closing only the second cam surface continues to contact the adjacent cam, and
wherein the predetermined cam angle corresponds to a maximum valve lift.

2. The center pivot roller rocker arm assembly of claim 1, wherein the lost motion assembly is positioned over the rocker shaft bore.

3. The center pivot roller rocker arm assembly of claim 1, wherein the lost motion assembly comprises a rotatable member, and wherein the guide end is positioned with the rotatable member.

4. The center pivot roller rocker arm assembly of claim 3, wherein the rotatable member comprises a pass-through, and wherein the guide end is slidable in the pass-through.

5. The center pivot roller rocker arm assembly of claim 4, wherein the lost motion socket comprises a socket pass-through, and wherein the guide end is slidable in the socket pass-through.

6. The center pivot roller rocker arm assembly of claim 1, wherein, when the latching assembly is unlatched, the main cam surface is configured to convey a main valve lift profile to the valve end, and, when the latching assembly is latched, the second cam surface is configured to convey a second valve lift profile to the valve end.

7. The center pivot roller rocker arm assembly of claim 1, wherein the main cam surface is configured with a roller of a main extent, and wherein the second cam surface is configured with a second roller of a second extent, and wherein the main extent and the second extent are configured so that a rotating cam of the adjacent cam acts on both the main cam surface and the second cam surface when the latching assembly is latched.

8. The center pivot roller rocker arm assembly of claim 1, wherein the main roller rocker arm comprises a recess in the cam end, and wherein the second cam end seats in the recess.

9. A center pivot roller rocker arm assembly comprising:
a main roller rocker arm comprising:
a rocker shaft bore;
a valve end;
a cam end; and a main cam surface on the cam end;

a second roller rocker arm, comprising:

a second rocker shaft bore;

a second cam end; and a second cam surface on the second cam end; and a latching assembly coupled to the rocker shaft bore and configured to latch and unlatch the main roller rocker arm to the second roller rocker arm, wherein, when the latching assembly is latched, at a predetermined cam angle of an adjacent cam both the main cam surface and the second cam surface are configured to contact the adjacent cam and after the predetermined cam angle and until a valve closing only the second cam surface continues to contact the adjacent cam, and wherein the predetermined cam angle corresponds to a maximum valve lift, wherein the main roller rocker arm comprises a main latch socket extending from the rocker shaft bore and a main latch configured to slide in the main latch socket, and wherein the second roller rocker arm comprises a second latch socket and a secondary latch configured to slide in the second latch socket.

10. The center pivot roller rocker arm assembly of claim 9, wherein the second latch socket is configured between the second cam surface and a lost motion mount.

11. A center pivot roller rocker arm assembly comprising:

a main roller rocker arm comprising:

a rocker shaft bore;

a valve end;

a cam end; and a main cam surface on the cam end;

a second roller rocker arm, comprising:

a second rocker shaft bore;

a second cam end; and a second cam surface on the second cam end; and a latching assembly coupled to the rocker shaft bore and configured to latch and unlatch the main roller rocker arm to the second roller rocker arm, wherein, when the latching assembly is latched, at a predetermined cam angle of an adjacent cam both the main cam surface and the second cam surface are configured to contact the adjacent cam and after the predetermined cam angle and until a valve closing only the second cam surface continues to contact the adjacent cam, and wherein the predetermined cam angle corresponds to a maximum valve lift, wherein the main roller rocker arm is stepped so that the cam end and the valve end are co-planar, but a lost motion mount is not co-planar with the cam end or the valve end, and wherein the second roller rocker arm is stepped so that a body portion abuts the main roller rocker arm while a second lost motion mount is co-planar with the lost motion mount and the second cam surface.

12. The center pivot roller rocker arm assembly of claim 11, wherein the lost motion mount comprises a socket, wherein the second lost motion mount comprises a clevis, and wherein a lost motion assembly comprises a spring guide mounted to span the socket and the clevis.

* * * * *